US006257296B1

(12) United States Patent
Pallas et al.

(10) Patent No.: US 6,257,296 B1
(45) Date of Patent: Jul. 10, 2001

(54) PRESSURE PLATE ARRANGEMENT FOR PRODUCTION OF MULTILAYER CORRUGATED CARDBOARD

(75) Inventors: Dieter Pallas, Lenthfoerden; Manfred Schommler, Hamburg; Jurgen Becker-Viereck, Pinneberg, all of (DE)

(73) Assignee: Peters Machinenfabrik GmbH, Hamburg (DE)

( * ) Notice: Subject to any disclaimer, the term of this patent is extended or adjusted under 35 U.S.C. 154(b) by 0 days.

(21) Appl. No.: 09/286,556

(22) Filed: Apr. 5, 1999

(30) Foreign Application Priority Data

Apr. 8, 1998 (DE) ..... 198 15 863

(51) Int. Cl.[7] ..... B31F 1/28

(52) U.S. Cl. ..... 156/470; 156/205; 156/210; 156/583.1

(58) Field of Search ..... 156/205, 210, 156/470, 583.1; 100/315, 321, 324, 325, 326

(56) References Cited

U.S. PATENT DOCUMENTS 5,244,518 * 9/1993 Krayenhagen et al. ..... 156/64
5,256,240 * 10/1993 Shortt ..... 156/470
5,456,783 * 10/1995 Sissons ..... 156/210
5,495,092 * 2/1996 Marschke et al. ..... 219/388
5,501,762 * 3/1996 Marschke et al. ..... 156/470
5,662,765 * 9/1997 Titz et al. ..... 156/470
5,788,803 * 8/1998 Sissons et al. ..... 156/359
5,915,295 * 6/1999 Lauderbaugh ..... 100/38
6,110,095 * 8/2000 Finke et al. ..... 493/463

OTHER PUBLICATIONS

"The Double Facer Group," Brochure No. 2 (694G)0.5 of Messrs. Peters Maschinenfabrik GmbH.

* cited by examiner

*Primary Examiner*—James Sells
(74) *Attorney, Agent, or Firm*—Allen N. Friedman; McCarter & English LLP

(57) ABSTRACT

The invention relates to a pressure plate arrangement for joining together a plurality of material webs each comprising at least one plain web and/or at least one corrugated web, to form a corrugated cardboard web (P), at least one of the material webs being provided with adhesive at least in sections. The arrangement comprises a contact pressure unit (14) provided with a pressure plate (22), and a heatable counterpressure plate (26), between which the material webs being joined together are passed. The contact pressure unit (14) and the pressure plate (22) are arranged to be approachable to or removable from the counterpressure plate (26), wherein the pressure plate (22) is also constructed to be heatable. The invention also relates to apparatus for joining together a plurality of material webs comprising a plurality of such pressure plate arrangements.

26 Claims, 6 Drawing Sheets

PRESSURE PLATE ARRANGEMENT FOR PRODUCTION OF MULTILAYER CORRUGATED CARDBOARD

PRIOR APPLICATIONS

This application claims priority from prior filed German application-Germany No. 198 15 863.7, filed Apr. 8, 1998.

GOVERNMENT SPONSORED RESEARCH

Not applicable

BACKGROUND OF THE INVENTION

1. Field of the Invention

The invention is in the field of devices for the fabrication of corrugated cardboard.

2. Brief of Description of the Background Art

The invention relates to a pressure plate arrangement for joining together a plurality of material webs each comprising at least one plain web and/or at least one corrugated web, to form a corrugated cardboard web. At least one of the material webs is provided with adhesive at least in sections. The arrangement comprises a contact pressure unit provided with a pressure plate, and a heatable counter pressure plate, between which the material webs to be joined are passed. The contact pressure unit and the pressure plate are provided with means to vary their separation from the counterpressure plate.

Pressure plate arrangements of this kind are known from the prior art. For example, the brochure "The Double-Facer Group", Brochure No. 2 (694G) 0.5 of Messrs Peters Maschinenfabrik GmbH, describes an arrangement of this kind on Page 10. In this arrangement, the material webs provided with adhesive, contact the heatable counterpressure plate and are pressed against one another from the opposite side by means of the pressure plates. The supply of heat via the heatable counterpressure plate accelerates curing of the adhesive. Of course in the case of multi-layer corrugated cardboard webs, i.e. corrugated board webs having two or more webs (e.g. double-wall corrugated cardboard), the problem arises that the temperature in the corrugated board decreases with increasing distance from the heated counterpressure plate, so that complete drying of the adhesive points remote from the counterpressure plate takes a relatively long time. To counteract this problem, in the case of moving material webs it is either necessary to appropriately reduce the speed of movement in order to allow adequately long heat treatment of the adhesive locations, or else it is necessary to appropriately lengthen the heatable counterpressure plate. Alternatively, it is necessary to appropriately increase the amount of heat supplied per unit of time. Thus, the required heat treatment expense increases with increasing corrugated board thickness and/or increasing weight per unit area.

Of course there are economic and practical limits both to reducing the speed of movement of the material web, to lengthening the apparatus, and also to increasing the amount of heat supplied per unit of time via the counterpressure plate. It is, therefore, an object of this invention to realize a pressure plate arrangement of the above type whereby the adhesive curing process can be accelerated for the same speed of movement, the same apparatus length and the same heat supply via the counterpressure plate.

SUMMARY OF INVENTION

In a pressure plate arrangement of the above mentioned type this problem is solved by providing a heatable pressure plate. By heating both the counterpressure plate and the pressure plate it is possible to supply heat to the corrugated board from both sides. While the heat supply rate to the counterpressure plate remains constant, the heat supply as a whole can be increased and a more uniform temperature profile through the thickness of the corrugated board is produced. As a result, first the gelling, and then the curing of the adhesive is rendered more uniform through the thickness of the corrugated board. Thus, there is no longer a delay in curing with increasing distance from the counterpressure plate. Because of the fact that the curing process is rendered more uniform through the thickness of the corrugated board, the pressure plate arrangement according to the invention enables reduction of the treatment time required for curing. Consequently, the transit times are quicker in the production of corrugated board or else the minimum length required of the pressure plate arrangement is reduced for a moving corrugated cardboard web. This also applies to large corrugated board thicknesses and/or weights per unit area.

BRIEF DESCRIPTION OF THE DRAWINGS

FIG. 6 shows detail views in the region of a connection point according to Detail VI in FIG. 2, wherein:

FIG. 7 is a schematic diagram showing exemplary circuit arrangements within a pressure plate matrix, wherein:

DETAILED DESCRIPTION OF THE INVENTION

Figure 1:
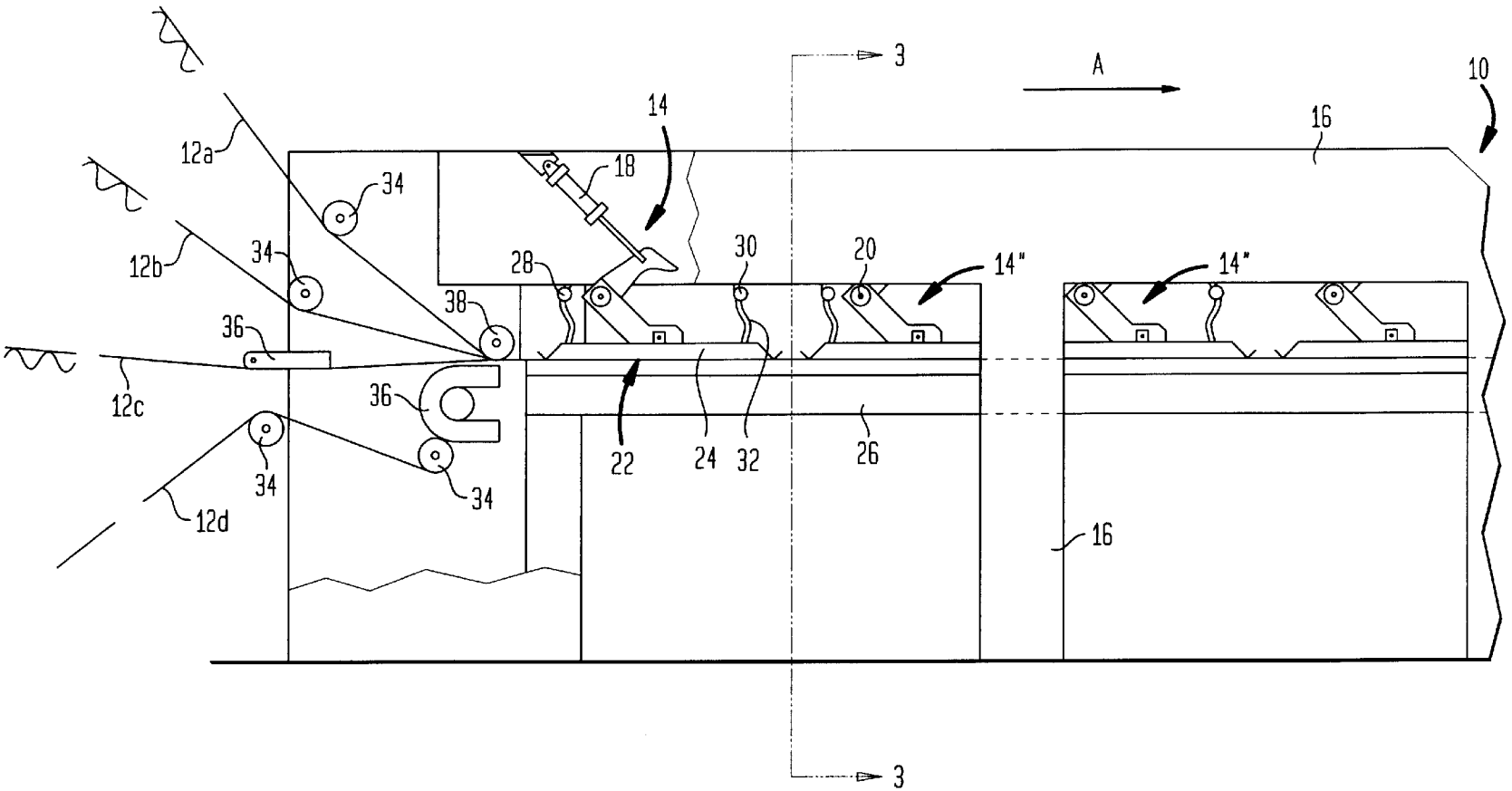
FIG. 1 is a side elevation of the material web entry end of an apparatus according to the invention, such apparatus being intended for joining together a plurality of material webs.

Pressure plate heating can be achieved in various ways. For example, heating filaments can be provided in or on the pressure plate to allow resistive pressure plate heating. Preferably, however, a cover plate is placed on that side of the pressure plate away from the counterpressure plate. Together with the pressure plate, the cover plate encloses a cavity that can be supplied with a heat transfer fluid. In this way, the pressure plate is made heatable with the same media that are already normally available at the operating site because of the similar heating of the counterpressure plate. Thus, it is also possible to easily retrofit existing plants. Various substances are possible heat transfer fluids, e.g., high temperature hydraulic oils. Preferably, however, steam is used as the heat transfer fluid because, for example, of its low production cost and good environmental compatibility.

The pressure plate and cover plate can be made of various materials depending, for example, on the heat transfer fluid used. They can be made of plastic or plastic-coated plates. Preferably, however, the pressure plate and/or the cover plate is/are made of metal, preferably of stainless steel. This guarantees a very robust and service-friendly arrangement with good thermal conductivity properties.

To ensure application of uniform pressure to the flat corrugated board web by the pressure plate, the wall thickness of the pressure plate is between approximately 3 mm and approximately 5 mm, preferably approximately 4 mm. Since the cover plate is not subjected to such high mechanical loads, is wall thickness can be much less. The wall thickness of the cover plate is preferably, between approximately 0.5 mm and approximately 2 mm, most preferably approximately 1.5 mm. Also, wall thicknesses of this magnitude allow relatively "rapid-reaction" heat control for heating of the pressure plate, since the volumes to be heated can be kept small.

To feed heat transfer fluid to the cavity enclosed between the pressure plate and the cover plate, the cavity is adapted to be connected to at least one fluid entry tube and at least one fluid discharge tube. This allows the fluid system for the heatable pressure plate to be incorporated in an overall fluid system, so that the heat transfer fluid can flow through the fluid supply tube, the cavity enclosed between the pressure plate and the cover plate, and through the fluid discharge tube. Advantageously, the fluid supply and discharge tubes are made flexible to permit movement of the contact pressure unit and the pressure plate relatively to the counterpressure plate.

To allow simple connection of the fluid supply and discharge tubes to the contact pressure unit, at least two pipe connections are provided for connection to the fluid tubes. In the case of a metal cover plate, these pipe connections can be welded directly thereto. If required, it is also possible to provide relief valves or other pneumatic or hydraulic elements on the cover plate.

To form the cavity between the pressure plate and the cover plate, the cover plate is sealed to the pressure plate preferably at its perimeter. This sealed connection can be obtained by gluing or, preferably, by welding in the case of a metal pressure plate and cover plate. This latter possibility produces a particularly rugged and reliable sealed connection between the pressure plate and the cover plate.

In order to increase the stability and rigidity of the heatable pressure plate, the cover plate is connected to the pressure plate at a plurality of, preferably, uniformly distributed intermediate points, the cavity between these connecting points being arched. A connection of the pressure plate and cover plate of this kind also allows very simple production of the cavity, as will be described below. As a result it is possible to place a cover plate substantially flat, sealing it to the pressure plate at the cover plate's perimeter, and also provide individual connecting points in the region inside the perimeter. In the case of a metal pressure plate and cover plate, the connection can preferably be made by welding or spot welding. After such connection, a hydraulic fluid, preferably water, is forced under high pressure between the contacting pressure plate and cover plate through suitable supply and discharge tubes, for example the pipe connections already described. Because of the thinner wall thickness of the cover plate relative to the pressure plate, plastic deformation of the cover plate in the form of bulges is produced under the high pressure of the hydraulic fluid, forming a continuous multi-arched cavity. By suitably supporting the pressure plate, it is possible to prevent the latter from also undergoing plastic deformation. The hydraulic fluid can then be removed from the cavity and the pressure plate subjected to further treatment.

Conduct of the material webs between the pressure plate and the counterpressure plate can be effected either by a discontinuous or, preferably, continuous material web movement. To prevent obstructing movement of the corrugated board web due to material web seams, or "splices", the pressure plate is provided with a guide surface section on the material web entry end and, if required, also on the material web exit end. This enables a seam to slide unobstructed beneath the pressure plate and prevents warping in the seam splice zone due to compression of the material web portions.

According to the invention, to provide for variable positioning of the pressure plate, the contact pressure unit comprises a pressure plate mounting and an adjusting device for moving the pressure plate toward the counterpressure plate and for moving the pressure plate away from the counterpressure plate. For application of uniform pressure to the corrugated board by the pressure plate mounting, according to the invention, the pressure plate mounting comprises at least one mounting member fixed to the pressure plate preferable by attachment to the cover plate. As a result, the pressure plate can be mounted to the pressure plate mounting for sufficient stability.

Preferably, the at least one mounting member comprises a plurality of projections that are attached to the cover plate at some of the pressure plate connecting points. The provision of projections on the mounting member is particularly advantageous when the cavity enclosed between the pressure plate and the cover plate is of arched construction as a result of the hydraulic expansion described above. In that case it is possible to limit the connections between the mounting member and the pressure plate or the cover plate, to the connecting points or some of the connecting points, so that the shape of the arched cavity is not changed when the mounting member is placed on the pressure plate or cover plate.

Connecting the pressure plate and mounting member via projections attached at the connecting points, is particularly advantageous if there is no mechanical contact between the mounting member and the cover plate other than by way of the projections. In other words, according to the invention, between its attachment projections the at least one mounting member is placed at a distance from the cover plate. This prevents thermal contact between the cover plate and the mounting member, through which heat could flow away from the pressure plate. The gap thus acts as insulation between the mounting member and the cover plate.

As an alternative to connecting the pressure plate and mounting web by means of a plurality of projections, screw bolts are attached to the cover plate, preferably at some of the pressure plate connecting points and substantially perpendicular to the pressure plate, by means of which the at least one mounting member is bolted, to the pressure plate directly or by means of at least one intermediate member. A connection of this kind between the pressure plate or the cover plate and the mounting web via screw bolts is particularly assembly-friendly, so that the pressure plate can be easily removed from and fitted to the mounting member particularly for repair and/or replacement.

For movement of the pressure plate relative to the counterpressure plate, according to the invention, an adjusting device comprises a lever assembly articulated the machine's frame, and an adjusting drive connected to the lever assembly. The adjusting drive preferably comprises at least one fluid actuated cylinder and piston device. The adjusting drive can be hydraulically or pneumatically actuated. Apparatus of this kind is insensitive to the working environment and provides good functional reliability with minimal maintenance. Because corrugated cardboard products to be bonded together vary widely in, for example, thickness and shape it is desirable for all products to be capable of manufacture with one and the same pressure plate arrangement. For this purpose, advantageously, the position of the pressure plate relative to the counterpressure plate, and the contact pressure should be variable. To achieve this with simple means, according to the invention, the force exerted by the adjusting drive is variable, preferably smoothly variable. In this connection also, preferably, the lever arrangement is pivotally connected to the at least one mounting member. As a result of the provision of a pivoting connection this kind, application uniform pressure over the entire contact surface between the corrugated board web and the pressure plate is possible for any change of position or force of the adjusting drive.

The invention also relates to an apparatus for joining together a plurality of material webs comprising a plurality of pressure plate arrangements according to the above description. In an apparatus of this kind, according to the invention, the pressure plate arrangements are positioned in the form of a matrix, either adjacent one another parallel to the feed direction of the material web and/or transverse to the feed direction. In a matrix arrangement consisting of a plurality of pressure plate arrangements, heatable according to the invention in and transverse to the feed direction, it is possible to obtain a large-area variable treatment on both sides of the corrugated card board web. The treatment can be "locally tailored" in respect of contact pressure and heat supply, as required. This is advantageous for high production capacity.

Furthermore, order to produce economic operation of the apparatus according to the invention, at least some of the pressure plate arrangements are made heatable by a common heating device, and are preferably adapted to be fed jointly with heat transfer fluid. This means that in each case a plurality of pressure plate arrangements are associated with and are fed by an overall heating system. In the case of a heating arrangement with a system carrying heat transfer fluid, the heat transfer fluid can flow through individual pressure plate arrangements in different sequences determined by specific "circuits". Thus, according to the invention in an alternative arrangement, the heat transfer fluid flows in series through the pressure plate arrangements associated with a common overall heating device (series circuit). In these conditions the temperature drops in the direction of flow, since the heat transfer fluid, over its flow path, delivers heat to the pressure plate arrangement through which it flows and to the environment.

An alternative circuit is one in which the heat vehicle fluid flows in parallel through the pressure plate arrangements associated with a common heating device (parallel circuit). With an arrangement of this kind, fluid of the same temperature flows through each of the pressure plate arrangements, so that they also have substantially the same temperature.

According to the foregoing, different heat supply profiles can be set by selecting different circuits (series circuit, parallel circuit) within a matrix-like pressure plate arrangement. In this way it is possible to maintain a higher temperature, for example, in the region of the edges parallel to the feed direct than the temperature in the central zone. In some situations, this is advantageous, since moisture is driven off when the adhesive dries and has to be discharged along the ribs of the corrugated webs, so that the relative moisture in the edge zone is greater than in the central zone. However, temperature gradients in the feed direction and surface temperature gradients are also possible. It is also possible to not heat individual pressure plates within the matrix arrangement by not supplying them with heat transfer fluid. Thus, the various circuit arrangements allow direct adjustment of the pressure plate arrangements to accommodate the corrugated product being manufactured, for example, depending on the number of corrugated webs and the material weight per unit area.

The individual pressure plates can each be adjusted relative to the counterpressure plate by the individual adjusting devices individually or provided with mutual mechanical coupling by means of adjusting drives coupled to a plurality of pressure plates.

The invention will be explained in detail below with reference to a number of exemplified embodiments and the accompanying drawings wherein:

FIG. 1 shows an apparatus of the invention 10 for combining a plurality of material webs 12*a,* 12*b,* 12*c* and 12*d* to form corrugated cardboard. The webs 12*a,* 12*b,* 12*c* are composite webs each consisting of a plain web and a corrugated web, while web 12*d* is only a plain web. The apparatus comprises a plurality of contact pressure units 14, each mounted on a W machine frame 16 with an adjusting drive 18 and articulated on carrier shafts 20. A pressure plate 22 is mounted on the underside of the contact pressure unit 14 by means of mounting members 24. A counterpressure plate 26 fixed on the machine frame 16 is mounted beneath the pressure plate 22 and extends substantially horizontally and, together with the pressure plate 22 of the contact pressure unit 14, forms a substantially parallel pressure plate arrangement.

The pressure plate 22 and the counterpressure plate 26 are each constructed to be heatable, although the heatable construction of the counterpressure plate 26 is well known in the act and will not be discussed in detail here. We simply point out that heating of the counterpressure plate 26 can be effected preferably by means of a system having a heat transfer fluid. In this exemplified embodiment the pressure plate 22 is also heatable by means of a system employing heat transfer fluid. For this purpose, the pressure plate 22 is fed with heat transfer fluid from supply and discharge lines 28 and 30 through flexible fluid tubes 32.

During operation, the material webs 12*a*–12*d,* which have preferably been coated with adhesive immediately before entering the entry side of the apparatus 10, such adhesive having been applied at least in sections in the region of the exposed corrugation crests, are fed via guide rollers 34 and guide elements 36 to a connecting roller 38, where they are pressed against one another at the sections provided with the adhesive. The adhesive situated at the contact points between the individual webs 12*a*–12*d* is still liquid or moist at this time, so that the webs still adhere relatively weakly to one another immediately downstream of the connecting roller 38, relative to the feed direction A. To obtain corrugated cardboard in which the individual material webs 12*a*–12*d* forming the board adhere to one another sufficiently firmly, the corrugated board must be subjected to pressure in that section of the apparatus 10 following the connecting roller 38 in the feed direction A. At the same time heat must be supplied to accelerate the adhesive gelling process and the subsequent adhesive curing process. This is effected by the co-operation of the contact pressure units 14 with the pressure plates 22 and the counterpressure plate 26. It should be noted that, preferably, the first three contact pressure units 14, 14', 14" following the connecting roller 38 in the feed direction A, are constructed to be heatable, since, in a typical application, after the third contact pressure unit 14" the adhesive has gelled or is cured to such an extent that further bilateral heat supply from the heatable contact pressure unit 14 and heatable counterpressure plate 26 is not necessary. Of course, depending on the required speed of movement of the corrugated board and the type of corrugated board product being manufactured, more or fewer heatable contact pressure units 14 can be supplied in the feed direction A.

Figure 2:
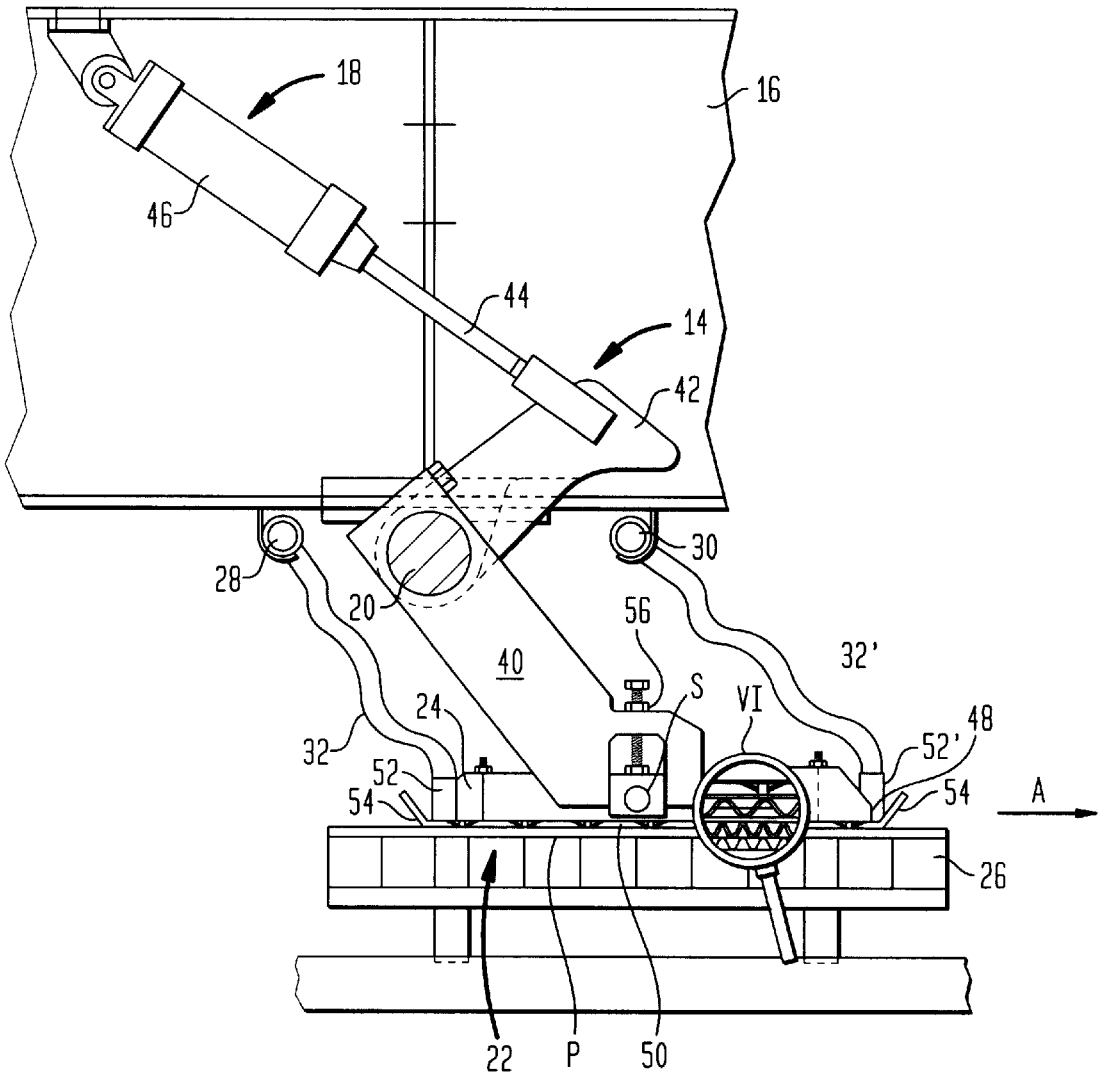
FIG. 2 is a side elevation of a detail of a contact pressure unit and an adjusting drive of FIG. 1.

FIG. 2 is a detail of a contact pressure unit 14 as seen in the overview given in FIG. 1. Those components that have already been shown in FIG. 1 have the same reference numerals in FIG. 2. The contact pressure unit 14 is pivotally mounted on the carrier shaft 20 by means of a mounting arm 40. An adjusting lever 42 is fixed in a substantially perpendicular alignment to the mounting arm 40 in the region of the pivot mounting on the carrier shaft 20. The adjusting drive 18, constructed as a hydraulic power element, is pivotally mounted on the adjusting lever 42 by means of a hydraulic piston 44. A hydraulic cylinder 46 that receives the hydraulic piston 44 is pivotally mounted on the machine frame 16.

At the end of the mounting arm 40 remote from the carrier shaft, there is a pivoting connection to the connecting member 24 in the region of its center of gravity S. As a result of this, the connecting member 24 remains in a substantially horizontal position upon movement of the mounting arm 40 around the carrier shaft 20.

The pressure plate 22 adjoins that side of the connecting member 24 that is remote from the mounting arm 40. The pressure plate construction and its coupling to the connection web 24 is shown in the enlarged detail with the reference numeral VI in FIG. 2. This detail will be discussed in greater depth hereinafter in connection with the description of FIGS. 6*a* and 6*b*. It should be noted here, however, that the pressure plate 22 is mounted on the connecting member 24 so that its center of gravity lies in a plane substantially perpendicular to the feed direction A, in which plane the center of gravity S of the connecting web 24 and the axis of rotation of the pivotal connection between the mounting arm 40 and the connection web 24 are situated.

A cover plate 48 is mounted on the top of the pressure plate 22 so as to enclose, together with the pressure plate 22, an arch-like cavity 50. This cavity is accessible through pipe connections 52 and 52', each of which is connected by means of the flexible fluid tubes 32, 32' to the overall feed tube 28 and the overall discharge tube 30 for the supply and discharge of heat transfer fluid. Guide surface portions 54 are provided at those ends of the pressure plate 22 that are at the entry and exit sides relative to the feed direction A. They allow unobstructed introduction of corrugated board into the gap between the pressure plate 22 and the counterpressure plate 22 and the sliding thereof in the gap. It should also be noted that an adjusting device 56 and that enables adjustment of the pivoting resistance, is provided at the pivotal connection between the mounting arm 40 and the connection web 24.

By actuation of the adjusting drive 18, which is constructed as a hydraulic power element, the pressure plate 22 can, as a result of retraction of the hydraulic piston 44 into the hydraulic cylinder 46 and the accompanying pivoting of the adjusting lever 42 and of the mounting arm 40 connected thereto, be pivoted about the carrier shaft 20 out of the position (shown in FIG. 2) of contact with the pressure plate 22, corrugated board P and counterpressure plate 26, into a position raised from the corrugated board P and the counterpressure plate 26. Extension of the hydraulic piston 44 from the hydraulic cylinder 46 causing an opposite pivoting movement about the carrier shaft 20, enables the corrugated board P to be subjected to pressure by means of the pressure plate 22. In that manner, the contact pressure unit 14 allows smooth positioning of the pressure plate 22 relative to the counterpressure plate 26 and hence smooth variation of the contact pressure and of the pressure applied to the corrugated board P.

Figure 3:
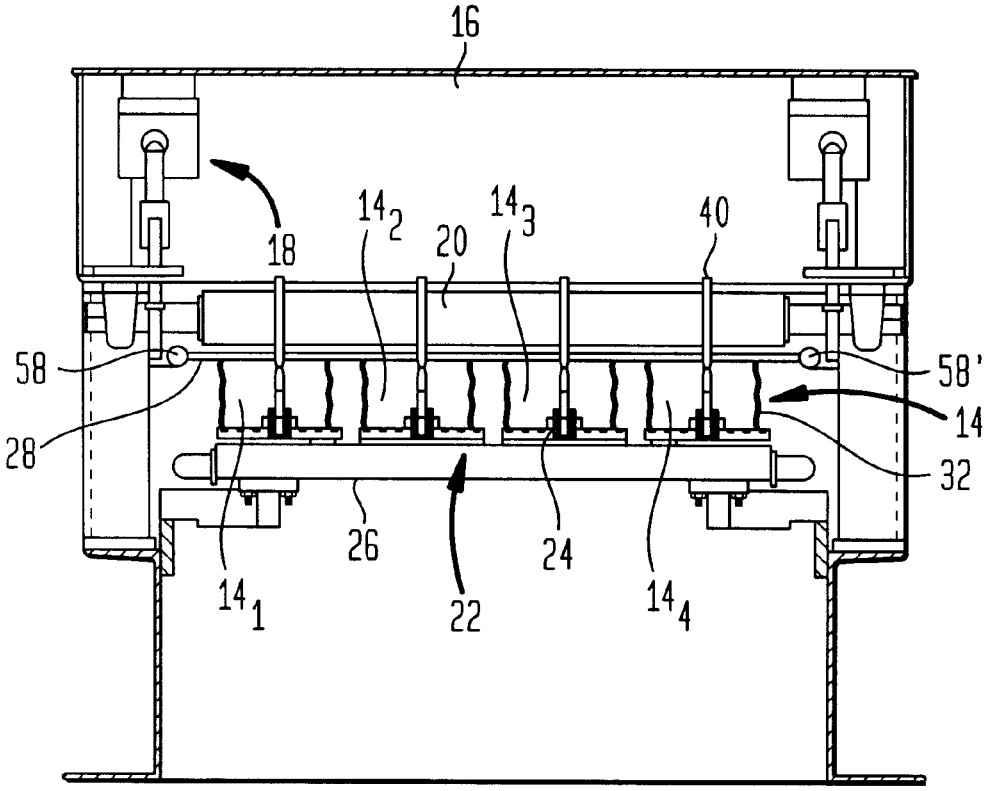
FIG. 3 is an elevation in section of the apparatus of the invention as viewed in the forward directions from the line III—III in FIG. 1.

FIG. 3 is a section along the line III—III of FIG. 1. Like components have like references as in FIGS. 1 and 2. It will be apparent from FIG. 3 that four contact pressure units 141, 142, 143, 144 are disposed side by side across the counterpressure plate 26, on the carrier shaft 20. An adjusting drive 18 for simultaneous pivoting of the contact pressure units 141, 142, 143, 144 about the carrier shaft 20 is provided at each of the bearing ends of the shaft 20. The overall fluid supply tube 28, which is situated transverse to the feed direction A and directed into the drawing plane of FIG. 3, is also shown. This tube 28 supplies all four contact pressure units $\mathbf{14}_1$–$\mathbf{14}_4$ with heat transfer fluid. The supply tube 28 extending transverse to the feed direction A is, in turn, connected to supply lines 58, 58' for the supply and discharge of heat transfer fluid.

Figure 4:
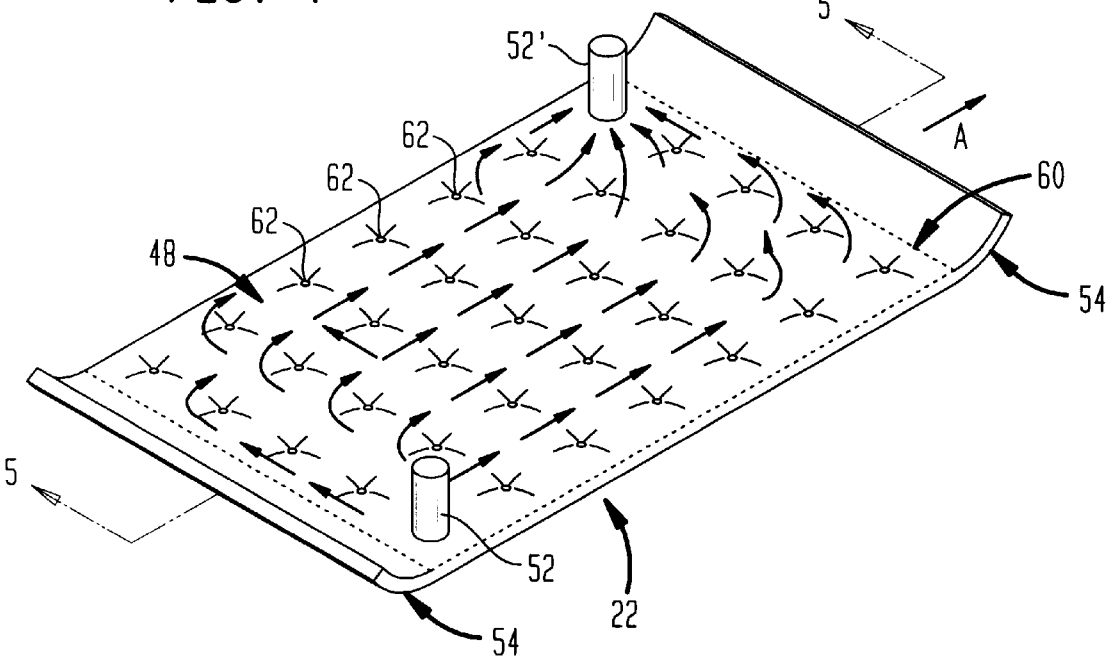
FIG. 4 is a perspective detail of a pressure plate and cover plate with pipe connections.

FIG. 4 is a perspective detail of a pressure plate 22 provided with a cover plate 48. For purpose of clarity the feed direction A in which a web of corrugated board moves is again shown. At the entry end and at the exit end of the pressure plate 22 upwardly extending guide surface portions 54 are provided.

Figure 5:
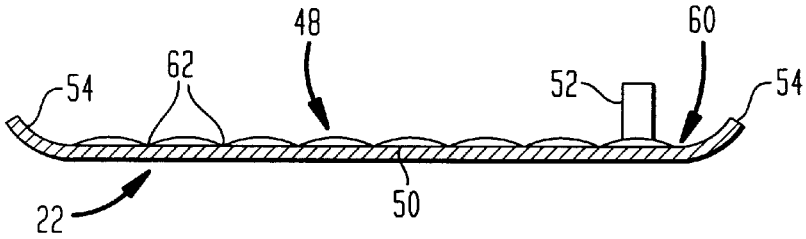
FIG. 5 is an elevation in section of the pressure plate according to the invention along the line V—V in FIG. 4.

The cover plate 48 and the pressure plate 22 are welded together along the perimeter 60 of the cover plate 48 to provide strong bond and a fluid seal. The cover plate 48 and the pressure plate 22 are also spot-welded at intermediate points 62 within the perimeter 60. The cover plate 48 is arched away from the pressure plate 22 by a suitable production process for example the hydraulic expansion process described above. This is also apparent from FIG. 5, which is a section along the line V—V of FIG. 4. The arch-like cavity 50 is thus formed between the pressure plate 22 and the cover plate 48 connected thereto. When the heat transfer fluid enters the pipe connections 52 welded to the cover plate 48 and flows out of the of the cover plate 48 to the pipe connection 52' placed diagonally to the pipe connection 52 on the cover plate 48, the heat transfer fluid flows through the cavity 50 in the direction of the dotted arrows in FIG. 4.

Figure 6A:
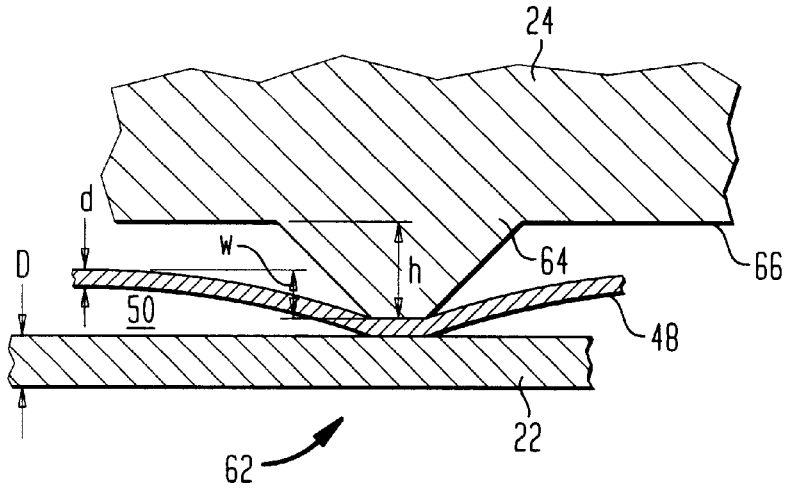
FIG. 6*a* is an elevation view, in section, showing a connection between the mounting web and the pressure plate via a projection.
Figure 6B:
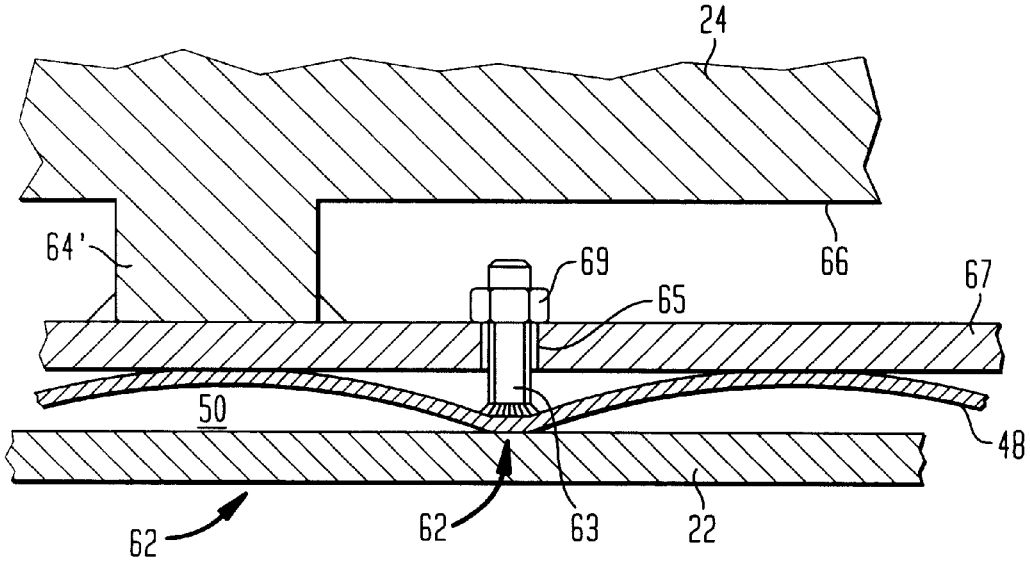
FIG. 6*b* is an elevation view in sections showing a connection between the pressure plate and the mounting web via a screw bolt.

FIG. 6 shows two details of alternative possibilities (FIGS. 6*a* and 6*b*) for attachment between the pressure plate 22 and the connecting web 24 as shown in the detail VI in FIG. 2. The corrugated board, comprising three corrugated webs shown in the detail VI, is omitted from FIG. 6.

In FIG. 6*a*, in accordance with a first alternative according to the invention for connecting the pressure plate 22 and the connecting member 24, a section of the connecting member 24 having a plurality of projections 64 at its underside is shown. (Only one of these is shown in FIG. 6*a*.) These projections correspond to the positions of some of the connecting points 62 between the pressure plate 22 and the cover plate 48. As shown in FIG. 6*a,* the connecting member 24 is connected at the projection 64 to the cover plate 48 at a spot weld 62 and, thus, to the pressure plate 22. The height h by which the projection 64 projects from the underside 66 of the connecting member 24 is in every case greater than the maximum arching w of the cover plate 48, so that there is not any mechanical contact, hence any thermal contact, between the underside 66 of the connecting member 24 and the cover plate 48 except at the undersides of the projections 64 in the region of the spot welds 62. This prevents heat loss from the heat transfer fluid to the connecting member 24 by thermal contact between the underside 66 of the connecting member 24 and the cover plate 48, which seals off the cavity 50 at the top. Any such heat loss would reduce the amount of heat available at the underside of the pressure plate 22 to accelerate curing of the adhesive in the corrugated board.

FIG. 6*a* shows an example of the ratio of the thickness D of the pressure plate 22 to thickness d of the cover plate 48. In respect of production by means of the hydraulic expansion process, as stated above, it is advantageous for the thickness D of the pressure plate 22 to be at least twice the thickness d of the cover plate 48.

FIG. 6*b* shows a second alternative according to the invention for connecting the pressure plate 22 and the connection web 24, like components having the same references as shown in FIG. 6*a*. In FIG. 6*b,* a screw bolt 63 is welded on the cover plate 48 perpendicular to the pressure plate 22 at a spot weld 62 on the side of the cover plate 48 facing the connecting member 24. Screw bolt 63 extends through a hole 65 in an intermediate member 67 that rests on the cover plate 48 at the arch crests. On the side of the intermediate member 67 opposite the cover plate 48, a hexagonal nut 69 is screwed on the projecting portion of the screw bolt 65 and presses the intermediate member 67 onto the arch crests of the pressure plate 48. Various screw fitting and locking means, for example washers or retaining rings, can be placed between the hexagonal nut 69 and the intermediate member 67, although they are not shown in FIG. 6*b* in order to avoid overloading the drawing. At a distance from the hole 65 on the side of the intermediate web 67 removed from the cover plate 48 the connecting member 24 is welded to the intermediary member 67 by means of a plurality of projection s 64' (only one of these being shown in FIG. 6*b*). However it is possible to interconnect the intermediate member 67 and the connecting member 24 by separate coupling members, although this is not shown, e.g. by a mutual screw connection. It is also possible to construct the connecting member 24 directly by a screw connection to the screw bolts 63 so that the intermediate member 67 can be omitted.

The alternative for the connection of the pressure plate 22 and connection member 24, as shown in FIG. 6*b,* has the advantage that this connection is simple to make and release so that the pressure plate 22 can more easily be removed from the connecting member 24 for assembly, repair and replacement purposes. Also, only minimal heat transfer is possible, due to the relatively small overall contact area between the cover plate 48 and the intermediate member 67.

Figure 7A:
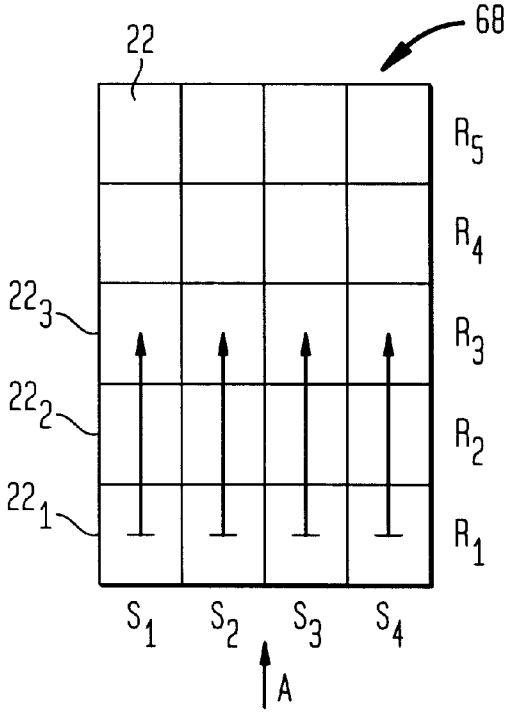
FIG. 7*a* shows a series circuit carrying heat transfer fluid flow parallel to the feed direction.

FIG. 7 shows various possibilities for transfer fluid flow through a plurality of heatable pressure plates 22 arranged in the form of a matrix, the matrix arrangement 68 being shown diagrammatically in plain view with rows $R_1$–$R_5$ transverse to the feed direction A and columns $S_1$–$S_4$ in the feed direction A. The arrows inside the matrix arrangement 68 show the direction of flow of the heat transfer fluid through the pressure plates 22. Pressure plates that do not show arrows are not fed with heat transfer fluid. FIG. 7*a* shows a matrix arrangement 68 consisting of twenty pressure plates, the first three rows $R_1$, $R_2$, $R_3$, extending transverse to the feed direction A, being fed with heat transfer fluid, while the rows $R_4$, $R_5$ are unheated. If column $S_1$ is studied by way of example, with this arrangement the heat transfer fluid is introduced into the pressure plate $\mathbf{22}_1$ at the first location on the entry side and delivers heat up there to the corrugated board web portion situated therebeneath. The fluid then flows from the pressure plate $\mathbf{22}_1$ into the pressure plate $\mathbf{22}_2$, the heat transfer fluid already having given up part of its heat energy and thus having a lower temperature than at the time of entry to the pressure plate $\mathbf{22}_1$. After flowing through the pressure plate $\mathbf{22}_2$, delivering further heat to the corrugated board, the heat transfer fluid flows into the pressure plate $\mathbf{22}_3$, and on flowing through the pressure plate $\mathbf{22}_3$ again has a lower temperature than at the time of entry into the pressure plate $\mathbf{22}_2$. The flow through the pressure plates of columns $S_2$ and $S_3$ is the same as the flow through the column $S_1$.

Thus, in the matrix arrangement shown in FIG. 7*a* there is a temperature gradient which drops in the feed direction A due to the heat dissipation in the direction of the fluid flow. An arrangement of this kind may be advantageous if the wet adhesive for sticking the individual materials webs together to form a corrugated board web is to be brought from the liquid state to a gel-like state in the region of the first pressure plate row $R_1$, something which requires an intensive heat supply. The gelled adhesive is then cured, less heat supply being necessary at the distance from the entry end of the matrix arrangement increases, since the degree of curing increases with increasing distance from the entry end.

Figure 7B:
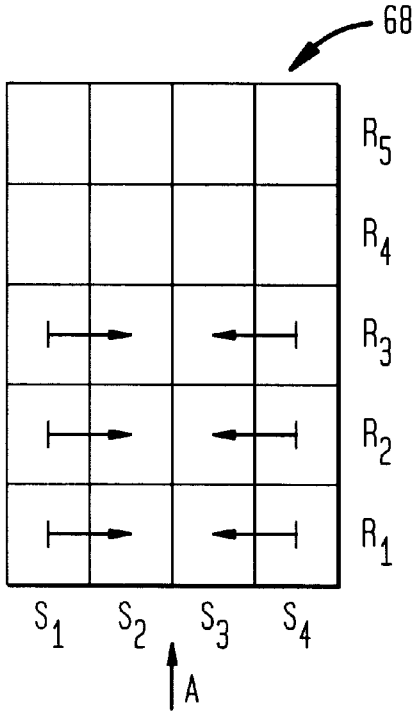
FIG. 7*b* shows a symmetric series circuit with heat transfer fluid flow transverse to the feed direction.

FIG. 7*b* shows a different arrangement of the fluid system in which heat transfer fluid is fed transverse to the feed direction A from the edge region (columns $S_1$, $S_4$) of the matrix arrangement 68 to the central region (columns $S_2$, $S_3$) and is taken out of the latter. In accordance with the above descriptions in connection with FIG. 7*a,* the circuit arrangement according to FIG. 7*b* gives a heat supply profile transverse to the feed direction A, a large amount of heat being fed in each case at the edge zone (columns $S_1$, $S_4$) of the corrugated board, with the heat supply decreasing towards the middle (columns $S_2$, $S_3$) of the matrix arrangement 68. A circuit arrangement of this kind is important, for example, if a greater degree of moisture occurs at the edge, in the manufacture of wide corrugated board webs, than in the center, so that a greater supply of heat is necessary to eliminate the moisture at the edge.

It is also possible to combine the above circuit arrangements show in FIGS. 7*a* and 7*b* or else not feed heat vehicle fluid to individual pressure plates while adjoining pressure plates are so fed, in order to obtain in that way locally quite specific temperature gradients, and hence heat supply profiles, adapted to the respective application (different corrugated board thickness, different corrugated board weights, different plant speeds, and so on).

We claim:

1. A pressure plate arrangement for joining together a plurality of material webs (12*a,* 12*b,* 12*c,* 12*d*) traveling in a feed direction (A) comprising at least one plain web (12*d*) and at least one corrugated web (12*a,* 12*b,* 12*c*), to form a corrugated board web (P), at least one of the material webs (12*a*–12*d*) being provided with adhesive, at least in sections, the arrangement comprising at least one contact pressure unit (14) and the pressure plate (22) being adopted for movement toward or away from the counterpressure plate (26), the arrangement further comprising means for heating the pressure plate (22), further comprising a cover plate (48)

disposed on that side of the pressure plate (22) remote from the counterpressure plate (26) so as, together with the pressure plate (22), to enclose a cavity (50), adapted to receive heat transfer fluid.

2. A pressure plate arrangement of claim 1 wherein the heat transfer fluid is steam.

3. A pressure plate arrangement of claim 1, wherein the cavity (50) is adapted for connection to at last one fluid feed tube (28, 32) and at least one fluid discharge tube (30, 32).

4. A pressure plate arrangement of claim 3, comprising at least two pipe connections (52, 52') for connection to the fluid tubes (32, 32').

5. A pressure plate arrangement claim 1, wherein the cover plate (48) is connected to the pressure plate (22) at a plurality of intermediate points (62), the cavity (50) between these connecting points (62) being arch-shaped.

6. A pressure plate arrangement of claim 1, wherein the cover plate (48) is sealed to the pressure plate (22), preferably in the region of its perimeter (60).

7. A pressure plate arrangement of claim 1, wherein the pressure plate (22) and cover plate (48) are made of metal.

8. A pressure plate arrangement of claim 7 wherein the metal is stainless steel.

9. A pressure plate arrangement of claim 1, wherein the wall thickness (D) of the pressure plate (22) is between approximately 3 mm and approximately 5 mm.

10. A pressure plate arrangement of claim 9 wherein the wall thickness (D) of the pressure plate (22) is approximately 4 mm.

11. A pressure plate arrangement of claim 1, wherein the wall thickness (d) of the cover plate (48) is between approximately 0.5 mm and approximately 2 mm.

12. A pressure plate arrangement of claim 11 wherein the wall thickness (d) of the cover plate (48) is approximately 1.5 mm.

13. A pressure plate arrangement of claim 1, wherein the contact pressure unit (14) comprises a pressure mounting (24, 40) and an adjusting device (18) for moving the pressure plate (22) toward and away from the counterpressure plate (26).

14. A pressure plate arrangement of claim 13, wherein the pressure plate mounting (24, 40) comprises at least one mounting member (24) connected to a cover plate (48).

15. A pressure plate arrangement of claim 14, wherein the at least one mounting member (24) comprises a plurality of projections (64) that are fixed to the cover plate (48) at a plurality of connecting points (62) to the pressure plate (22).

16. A pressure plate arrangement of claim 15, comprising at least one mounting member (24) with fixing projections (64) adapted for supporting the mounting web (24) at a distance (h-w) from the cover plate (48).

17. A pressure plate arrangement of claim 16, comprising screw bolts (63) fixed to the cover plate (48), at a plurality of the connecting points (62) to the pressure plate (22) and substantially perpendicular to the pressure plate (22), by means of which screw bolts (63) the at least one mounting member (24) is fixed to the pressure plate (22) directly or through the agency of at least one intermediate member (67).

18. A pressure plate arrangement of claim 10, wherein the adjusting device (18) comprises a lever arrangement (40, 42) articulated to a machine frame (16) and an adjusting drive connected to the lever arrangement (40, 42) and comprising at least one fluidically actuatable cylinder and piston device (44, 46), the adjusting drive being adapted for exerting an adjusting force.

19. A pressure plate arrangement of claim 18, wherein the adjusting force of the adjusting drive is variable.

20. A pressure plate arrangement of claim 18, wherein the lever arrangement (40, 42) is pivotally connected to the at least one mounting member (24).

21. An apparatus (10) for joining together a plurality of material webs (12*a,* 12*b,* 12*c* 12*d*), comprising a plurality of pressure plate arrangements of claim 1.

22. An apparatus of claim 21, wherein the pressure plate arrangements are disposed adjacent one another in at least the feed direction (A) of the material webs (12, 12*b,* 12*c,* 12*d*) or transverse to the feed direction (A).

23. An apparatus of claim 21, wherein at least a plurality of the pressure plate arrangements are heatable by a common heating device.

24. An apparatus of claim 23 wherein the heating device is adapted to be supplied with a heat transfer fluid.

25. An apparatus of claim 24, wherein the heat transfer fluid flows successively through the pressure plate arrangements associated with the common heating device.

26. An apparatus of claim 24, wherein the heat transfer fluid flows in parallel through the pressure plate arrangements associated with the common heating device.

* * * * *